US005341745A

United States Patent [19]

Strandli et al.

[11] Patent Number: 5,341,745

[45] Date of Patent: Aug. 30, 1994

[54] GRENADE CONTAINING AN INCENDIARY ELEMENT

[76] Inventors: Kare R. Strandli, Lyngv. 5; Colin Foreman, Lyngv. 18, both of 2830 Raufoss, Norway

[21] Appl. No.: 922,485

[22] Filed: Jul. 31, 1992

[30] Foreign Application Priority Data

Aug. 1, 1991 [NO] Norway ..... 912996

[51] Int. Cl.[5] ..... F42B 12/20; F42B 12/44

[52] U.S. Cl. ..... 102/499; 102/364; 102/473; 102/487

[58] Field of Search ..... 102/364, 473, 499, 500, 102/365, 487, 488

[56] References Cited

U.S. PATENT DOCUMENTS

| | | | |
|---|---|---|---|
| 1,207,215 | 12/1916 | Riccio | 102/473 |
| 1,464,221 | 8/1923 | Safford | 102/365 |
| 3,120,809 | 2/1964 | Custard | 102/364 |
| 3,291,050 | 12/1966 | Ahlert et al. | 102/364 |
| 5,121,691 | 6/1992 | Nicolas | 102/364 |

*Primary Examiner*—Harold J. Tudor
*Attorney, Agent, or Firm*—Bacon & Thomas

[57] ABSTRACT

Grenade comprising an incendiary element (3) which is situated in a retainer (1) projecting into a bore (5) in a charge (10) in the grenade shell. The incendiary element (3) has been pressed into the retainer (1) and is situated behind a transfer or booster charge (4). The retainer (1) may be mainly circular- cylindrical, in order to permit that both the incendiary element (3) and the transfer or booster charge (4) can be pressed over the entire cross section of the retainer (1).

2 Claims, 1 Drawing Sheet

GRENADE CONTAINING AN INCENDIARY ELEMENT

The present invention relates to a grenade containing an incendiary element.

Incendiary elements of pressed pyrophoric metal have been used in many different grenade designs, including grenades of smaller caliber where the inner diameter of the shell is less or equal to the mouth diameter of the shell. It is well known to press a layer of pyrophoric metal powder in the bottom of a shell, i.e. against the inside of its bottom, prior to filling and pressing explosive material in front of the metal powder. This method can, however, not be used when the inner diameter of the shell is substantially larger than its mouth diameter, because the latter determines the limit of the diameter of a pressing plunger to be inserted in the shell.

It is also well known to place a pre-pressed pellet of incendiary material against the inside of the bottom of a shell, and thereupon to cast explosive material in front of and around the pellet. From a safety viewpoint this method is acceptable for grenades of smaller caliber. For grenades of larger caliber casting of explosive material without any inserted pellet may lead to problems, for instance due to formation of bottom fissures or attachment to the wall, and the insertion of a pellet may lead to further problems, such as the formation of pores, cavities and fissures in the explosive material. This creates uncertainty during firing, due to the danger of "setback" in the explosive material and a possibility of adiabatic heating. The method is not recommendable for grenades having a main charge of pressed explosive material, because the safety is not acceptable. Pressing of explosive material around and against uneven surfaces of a pellet of metal powder may expose some explosive grains to friction or local heating.

The present invention provides a grenade which eliminates the problems and elements of risk associated with previously known incendiary elements. In the grenade in accordance with the invention the incendiary element has been pressed into a retainer, behind a transfer or booster charge, said retainer projecting into a bore in a charge in the shell of the grenade.

Due to the fact that the incendiary element is situated in a retainer for a transfer or booster charge, all elements of risk by pressing of the incendiary element and the explosive material and by %he succeeding firing of the grenade are eliminated. A retainer having a circular-cylindrical shape which permits a safe pressing without problems can be used, and without danger of friction against a pellet and without danger of any formation of cavities.

The invention also brings about the advantage that it permits the positioning of an incendiary element in an existing grenade which contains a retainer with a transfer or booster charge. This may be accomplished by removing the retainer from the grenade, by drilling of the well for the retainer in the main charge of the grenade to a larger length than earlier, and by inserting a new retainer which contains both a transfer or booster charge and an incendiary element in the drilled or lengthened well.

The invention will in the following be explained more detailed, with reference to the accompanying drawing.

Figure 1:
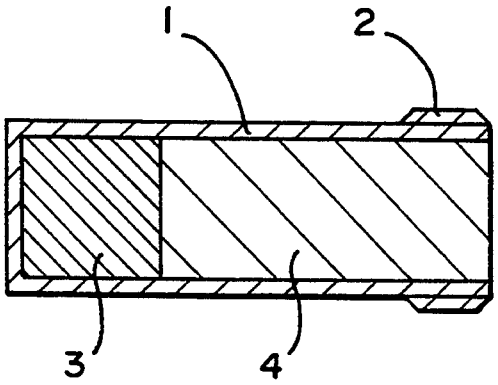
FIG. 1 shows an example of an embodiment of a retainer containing a transfer or booster charge and an incendiary element.

FIG. 1 shows a retainer 1, in the form of a mainly cylindrical box of metal, which contains a transfer or booster charge 4 and an incendiary element 3. The retainer 1 has an exterior threaded portion 2, adapted to be screwed into the rearward end of a fuse. During the manufacture a metal powder, which for instance may be a zirconium sponge powder, is initially pressed into the bottom of the retainer 1, for making of the incendiary element 3, whereupon the charge 4 is pressed. In order to compensate for the barrier constituted by the nonexplosive incendiary element 3 with respect to transfer of the explosive impulse to the charge or charges behind the retainer 1, a transfer or booster charge 4 may be used which is larger than what would be used in the absence of an incendiary charge. Moreover, a sufficiently large radial gap should be present between the retainer 1 and the inside of the grenade shell in which the retainer is inserted, in order to secure a reliable transfer of a shock wave to the main charge.

Figure 2:
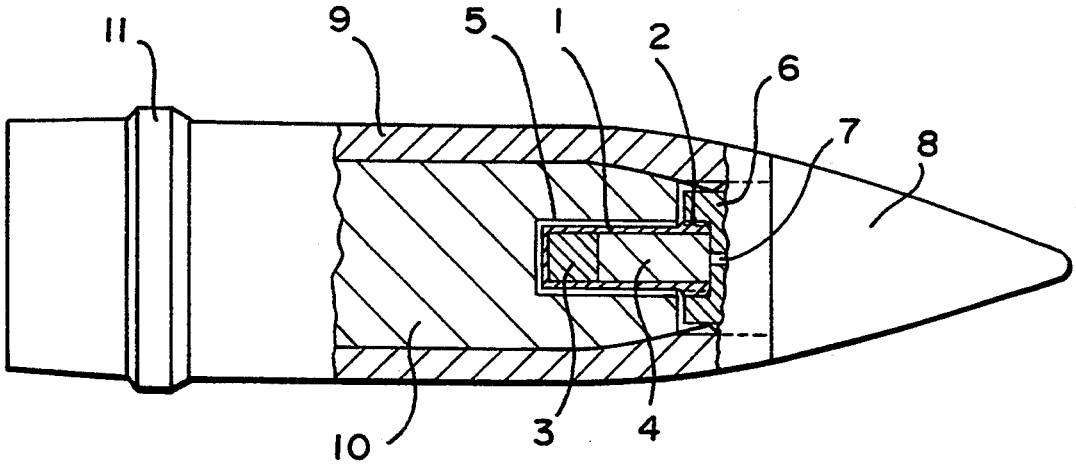
FIG. 2 shows how the retainer shown in FIG. 1 may be situated in a grenade.

FIG. 2 shows a grenade comprising a shell 9 equipped with a guide band 11 and a nose portion 8 having a fuse, of which fuse is shown a rearward portion 6 having an aperture 7 for transfer of an ignition impulse from the fuse to the transfer or booster charge 4, which is situated forwardly in the retainer 1. Behind the charge 4 an incendiary charge 3 has been pressed in, as it appears from FIG. 1. The retainer 1 is situated in a bore 5 in the charge 10 of the shell.

It will appear that both the incendiary element 3 and the transfer or booster charge 4 can be pressed over the entire cross section of the retainer 1, by insertion of a pressing plunger, and in such a manner that pressing can be performed without danger of friction and generation of heat or any formation of cavities.

We claim:

1. A grenade comprising:

a shell having a rearward closed end and a forward open end;

a main charge disposed in the shell and a bore centrally disposed within a forward end of the main charge;

a nose portion connected to the forward end of the shell;

a fuse in said nose portion having a threaded rearwardly extending opening;

an incendiary retainer in the form of a tube open at its forward end and closed at its rearward end, and including external threads disposed at its forward open end;

an incendiary element pressed into and extending entirely over the closed end of the retainer tube, said incendiary element extending forwardly only partially along the length of the retainer tube;

a transfer or booster charge filling the remaining interior of the retainer tube to its forward end;

said external threads of said retainer threadedly engaging the threads of said opening of said fuse; and said retainer disposed in said bore at the forward end of said main charge.

2. A grenade as claimed in claim 1, wherein said retainer defines a cylinder.

* * * * *